United States Patent [19]

Wohlleben et al.

[11] Patent Number: 4,873,534

[45] Date of Patent: Oct. 10, 1989

[54] HYBRID MODE FEED HORN HAVING FUNNEL-SHAPED HORN FLANGE WITH GROOVED CONICAL INNER SURFACE

[76] Inventors: Rudolf Wohlleben, Am Bogen 9, 5300 Bonn 1 (Röttgen); Johann Mutschlechner, Frankenstr. 31, 5357 Odendorf, both of Fed. Rep. of Germany

[21] Appl. No.: 90,586

[22] PCT Filed: Nov. 17, 1986

[86] PCT No.: PCT/EP86/00661

§ 371 Date: Jul. 20, 1987

§ 102(e) Date: Jul. 20, 1987

[87] PCT Pub. No.: WO87/03143

PCT Pub. Date: May 21, 1987

[30] Foreign Application Priority Data

Nov. 18, 1985 [DE] Fed. Rep. of Germany ..... 3540900

[51] Int. Cl.[4] ..... H01Q 13/06

[52] U.S. Cl. ..... 343/786; 343/761; 343/762

[58] Field of Search ..... 343/786, 772, 761, 839, 343/757, 762

[56] References Cited

FOREIGN PATENT DOCUMENTS 1199226 7/1970 United Kingdom ..... 343/786

OTHER PUBLICATIONS

Neelakantaswamy et al., "Open-Ended . . . Applicator", IEEE Trans. on Microwave Theory and Tech., vol. MTT-30, Nov. 1982, vol. 11, pp. 2005-2008.

Bahn et al, "Study of Control of Beamwidth of Radiation Pattern of a Waveguide Using Inclined Slotted Flanges", IEE Trans. on Antennas and Propagation, vol. AP-26, No. 3, May 1978, pp. 447-450.

Wohlleben et al, "Primarfokus-Erreger mit geringem Ruckstreuquerschnitt fur Parabolreflektoren", NTG--Fachberichte, Band 57, Vortrage der NTG-Fachtagung, 8 bis 11, Mar. 1977, VDE-Verlag, Berlin, pp. 81-85.

Neelakantaswamy et al, "Circular Waveguide Aperture with a Curved Corrugated Disk as a Primary Feed", G-AP International Symposium, Session 33-Antenna Design, Aug. 1973, Boulder, Colo., pp. 228-231.

*Primary Examiner*—Rolf Hille
*Assistant Examiner*—Michael C. Wimer
*Attorney, Agent, or Firm*—Fleit, Jacobson, Cohn, Price, Holman & Stern

[57] ABSTRACT

A hybrid-mode feed horn for feeding a reflector from the primary focus has a flange provided with grooves in an inner funnel-shaped surface thereof. The horn flange is formed to enable illumination of deep reflectors with a high aperture efficiency, low spill-over and high side-lobe suppression. The half opening angle $\theta o$ of the horn flange (7) is specified in the region $70° < \theta o < 80°$. An offset of the feeding waveguide (3) in relation to the horn throat plane (21) is adjustable.

13 Claims, 4 Drawing Sheets

HYBRID MODE FEED HORN HAVING FUNNEL-SHAPED HORN FLANGE WITH GROOVED CONICAL INNER SURFACE

CROSS REFERENCE TO RELATED APPLICATION(S)

This U.S. application stems from PCT International Application No. PCT/EP86/00661 filed Nov. 17, 1986, now No. WO8703143, May 21, 198

BACKGROUND AND SUMMARY OF THE INVENTION

The invention is related to a horn for the primary focus illumination of a reflector antenna with a horn flange which is arranged at the output end of a tubular circular waveguide and which widens in a funnel-shaped manner from the throat lying on this waveguide and which has on its inner funnel side grooves oriented in parallel with the axis of the input waveguide.

For such a known horn (as in German published patent application No. DE-OS 3144 319) in which the input waveguide ends precisely with the horn flange throat, by the grooves arranged in parallel to the axis and around the feeding waveguide, a structure is proposed to enable a very precise production of the grooves.

Specially, by such an accurate dimensioning a rather high suppression of the cross polarization is obtained. This known feed horn is specially designed in order to produce a radiation pattern with as low as possible cross polar sidelobes, whereas the aperture illumination or the covering of the reflector antenna to be fed by this horn is less important.

This invention is based on the task of improving the illumination of deep reflector antennas or mirrors, specially for f/D ratios$<0.35$, where f corresponds to the focal length and D to the aperture diameter of the reflector, in such a manner that under conservation of the least possible cross polarization a high aperture efficiency combined with a high spill over efficiency and a high side lobe suppression is obtained.

This task is by this invention solved by choice of the half opening angle $\theta_o$ of the flange enclosed between the waveguide axis and the inner envelope of the horn grooves to range in the region $70° < \theta_o < 80°$ and by a forward offset of the $TE_{11}$ mode circular waveguide aperture with respect to the horn throat, where this offset of the waveguide is adjusted to obtain the optimal angular width of the horn pattern suitable to the f/D ratio of the reflector.

Ideally, the illumination of covering of the reflector antenna should consist of a constant illumination power across the whole reflector aperture and a step to zero at the reflector rim. This would require a conical-formed field strength (power) characteristics of the feed horn, which has constant field strength inside the opening angle of the reflector. Unfortunately, this ideal case cannot be realized and the uniformity of the illumination especially for deep reflectors is more and more difficult to attain. On the other hand, deep reflectors with f/D$<0.35$ are of increasing interest, because the horn, being the feed, is more shielded against ground radiation producing additional thermal noise than in shallow reflectors. But it could surprisingly be shown by the invention that appropriate dimensioning of the horn flange opening angle and a suitable "matched" offset of the waveguide against the horn flange throat leads to extraordinary advantageous illuminations e.g. high aperture efficiencies between 50 and 60°/o and and a very high spillover efficiency (spillover about 2°/o) and a low sidelobe level of about −25 dB (compared against main lobe level). As, further, the cross polarization is considerably suppressed, i.e. the horn radiation characteristic practically shows high cylindrical symmetry, this invented feed is especially useful for circular polarized waves as are e.g. radiated by transmitters of direct TV satellites. The definition of the above mentioned parameters such as: aperture efficiency, spillover efficiency or sidelobe level are in correspondence with common international standards of antenna engineering as e.g. contained in JOHNSON, R. C., JASIK, H. Antenna Engineering Handbook, McGraw Hill, New York 1984, pages 1-5 to 1-7 or RUDGE, A. W., MILNE, K., OLIVER A. D.,KNIGHT,P.: The Handbok of Antenna Design, Peregrinus, London 1982, Vol. 1 pages 21–24.

Particularly good results for deep reflectors shall be obtained in a more narrow angular region of the horn flange opening angle, which is characterized by the domain $73° \leqq \theta_o \leqq 76°$.

Similarly, for the waveguide aperture offset a favoured domain was found which is characterized by the region $-0.25 \leqq L/\lambda_o \leqq +0.35$ where $\lambda_o$ is the free space wavelength and L is the perpendicular distance between the aperture plane of the horn flange and the aperture plane of the wave guide and the sign of L is positive for distances outside the inner horn flange volume enclosed between the funnel-shaped horn flange and the horn flange aperture plane and negative for distances inside of the horn flange volume.

Particularly, this invention is useful in the context of a feed application using a circular feeding waveguide. In this context it is sensible to choose a conical horn flange which has rotational symmetry to the axis of the waveguide. Especially, a preferred construction consists in a horn flange in the form of a cone of revolution.

A further option of this invention is the extension of the idea of the invention to depart from a single and fixed position of the waveguide offset (L), to the possibility of varying the value of the offset and to adjust it to different positions corresponding to changing requirements. This embodiment is characterized by the fact that the horn flange is adapted to axially slide on the feeding waveguide.

To constructionally realize this idea an embodiment is provided in which the horn flange is arranged on a cylindrical sheath which is fittingly guided on the outer surface of the waveguide. By this embodiment the continuity of the radio frequency connection of the horn flange with the waveguide is guaranteed and a variation of the waveguide aperture offset by shifting of the horn flange is rendered possible. To secure a definite radio frequency connection the horn flange is provided with a contact spring sliding on the outer surface of the waveguide.

In order to realize an accurately controllable shift of the horn flange on the waveguide, further, an electrical drive unit is provided. This arrangement is built in such a manner, that the sheath of the horn flange comprises a rack which engages a pinion which is driven by an electrical motor which is stationary with respect to the waveguide.

Finally, some dimensioning regions normalized to the wavelength of operation and providing particularly useful practical realizations of this invention have been found. These dimensions consist in the outer diameter of the horn flange $d_{ges}$, the inner diameter of the waveguide $d_{TE11}$, the axial groove depth s, the radial groove distance b and the radial groove thickness t with these regions lying in the ranges $1.86 \leqq d_{ges}/\lambda_o \leqq 3.6$ $0.59 \leqq d_{TE11}/\lambda_o \leqq 0.82$ $0.25 \leqq s/\lambda_o \leqq 0.35$ $0.07 \leqq b/\lambda_o \leqq 0.12$ $0.016 \leqq t/\lambda_o \leqq 0.024$, where $\lambda_o$ is the operation wavelength in free space.

BRIEF DESCRIPTION OF THE DRAWINGS

Further characteristics, details and advantages of the invention result from the following description and from the drawings, to which reference should be made concerning all typical revelations of the invention which were not pointed out in detail in the text: wherein.

DETAILED DESCRIPTION OF THE INVENTION

Figure 1:
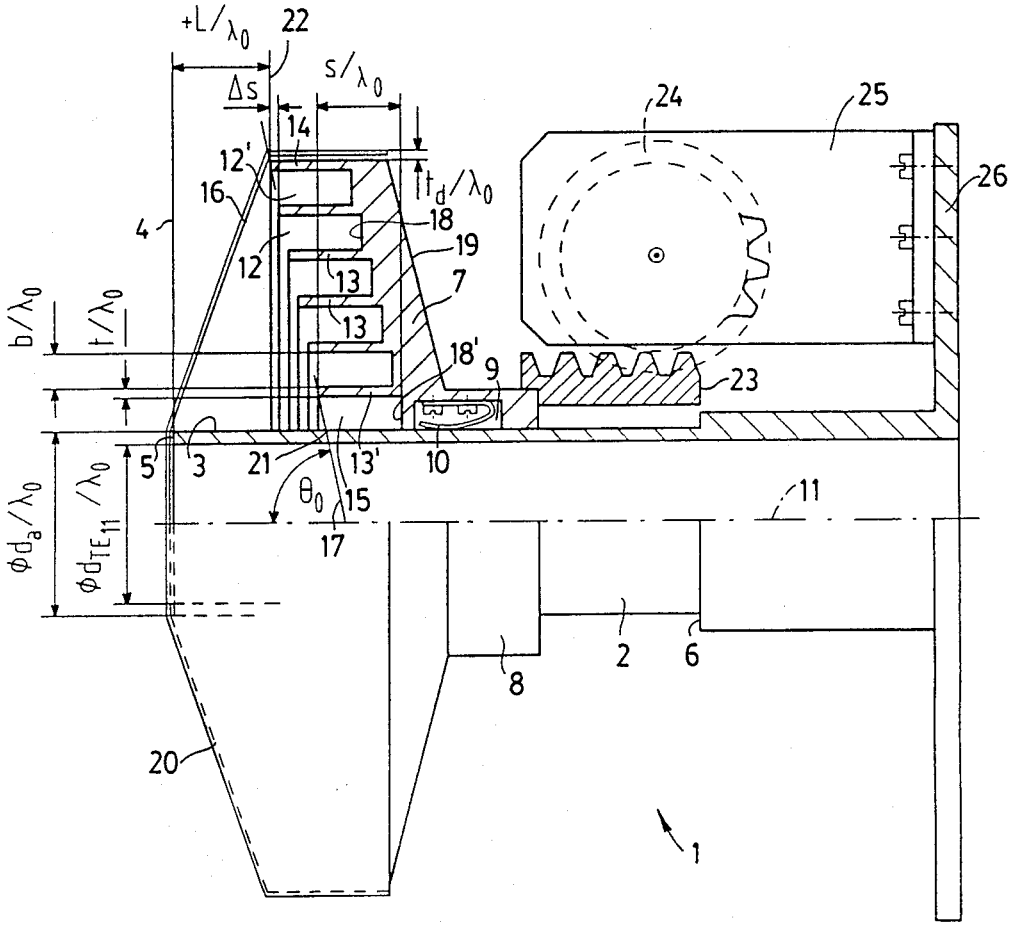
FIG. 1 is a partly cut view of the horn as viewed in a longitudinal section

Referring to FIG. 1, the horn with the reference no. 1 has a feeding circular waveguide 2 of the $TE_{11}$ wave mode being in the form of a circular waveguide of cylindrical inner cross section. The inner diameter of this circular waveguide normalized to the operation wavelength $\lambda_o$ is defined in FIG. 1 by $d_{TE11}/\lambda_o$. The outer mantle 3 of the circular waveguide in its free end region which is opposite the right RF input side in FIG. 1 is formed as a gliding surface part, which axially extends between the open free end 5 of the feeding waveguide 2 defining the aperture plane 4 of the feeding waveguide to a ring shoulder 6 of the outer mantle 3. On this gliding surface part forming the free end region of the outer mantle 3 a horn flange 7 is arranged. Horn flange 7 has a sheath 8 which is fittingly supported on this gliding surface and surrounds in the form of an annular ring the outer mantle 3 of the feeding waveguide 2. In order to ensure a positive radio frequency contact between the sheath 8 and the feeding waveguide 2, a ring-shaped recess 9 of the sheath 8 which is open towards the sheath houses a blade-shaped, circularly extending contact spring 10, which spring 10 lies under pressure on the gliding surface of the outer mantle 3.

The horn flange 7 in FIG. 1 exhibits rotational symmetry with respect to the central axis 11 of the waveguide 2 and extends in a funnel-shape radially outwardly from the sheath 8 with the funnel shape diverging towards the free end 5 of the feeding waveguide 2 and making a half opening angle $\theta_o$ with the central axis 11. In the funnel inner side of the horn flange 7 grooves, 12 of rectangular axial cross section of equal axial depth and equal radial width are provided concentrically to the central axis 11. The radial width normalized to the wavelength $\lambda_o$ of the grooves 11 is designated by $b/\lambda_o$ in FIG. 1. The individual grooves 12 are mutually separated by separation walls 13 extending parallel to the axis 11 and being in the shape of rings which are concentric in relation to the central axis 11 and are integral parts of the flange 7 itself. The radial thickness of these walls 13 normalized to the wavelength $\lambda_o$ is designated in FIG. 1 as $t/\lambda_o$. Further, in FIG. 1, the outer diameter of the feeding waveguide 2 in the region of the cylindrical gliding surface 3 normalized to the wavelength has the dimension $\theta d_a/\lambda_o$.

So, on the horn flange 7 five walls 13 of equal radial wall thickness mutually separate five grooves 12, with the walls 13 defining where the axial depth of the grooves 12 show equal axial lengths, which axial lengths are defined - after normalizing to the wavelength - in FIG. 1 as $s/\lambda_o$. The radially outmost groove 12' is outwardly limited by the cylindrical outer wall 14 of the horn flange 7, which has the same radial thickness and same axial length as the separation walls 13. Between the radially innermost separating wall 13' and the outer surface forming the gliding region 3 of the feeding waveguide 2 a further ring-shaped groove 15 of rectangular axial section is defined which has the same radial width as the grooves 12 and 12'.

The outer axial free ends 16 of the separating walls 13, 13' and of the cylindrical outer wall 14 pointing toward the free end 5 of the feeding waveguide 2 thus lie on a straight line 17 in FIG. 1 which includes the half opening angle $0_o$ of the horn flange with the central axis 11 of the waveguide 2. So these free ends 16 in FIG. 1 show each a mutual offset distance, which is referenced by $\Delta s$. The radially oriented bottom surfaces 18, 18' of the grooves 12, 12' and the ring-shaped groove 15, consequently show the same mutual offset of the same amount $\Delta s$. The backside 19 of the horn flange 7 opposite the free ends 16 is, as viewed in axial section, parallel to the straight line 17. So, a hybrid-mode horn is formed by this structure. The half opening angle $\theta_o$ varies in the region $70° \leqq \theta_o \leqq 80°$ and in practise the narrower region $73° \leqq \theta_o \leqq 76°$ should be preferred.

The front side of the horn 1, opposite the back side 19, is covered by a dielectrical radome 20, which is of about the same form - symmetrical to the radial plane - as the backside of the horn flange 7 itself. The thickness of this protecting radome 20 is neglibible compared to the wavelength $\lambda_o$. This thickness normalized to the wavelength of operation is in FIG. 1 defined as $t_d/\lambda_o$. Further, as may be seen from FIG. 1, the free end 5 defining the aperture plane 4 protrudes from the horn throat which is defined by the intersection of the horn throat plane described by the line 21 of coincident with line 17 with the feeding waveguide 2. This protruding waveguide offset is expressed in FIG. 1 by $L/\lambda_o$, the axial distance normalized to the operation wavelength $\lambda_o$, being the normalized distance between the aperture plane 4 of the wave guide 2 as defined by the free end 5 of the feeding waveguide 2 and the radial aperture plane 22 as defined by the free end 16 of the cylindrical outer wall 14 of the horn flange 7. As a preferred region of this waveguide offset, the interval $-0.25 \leqq L/\lambda_o \leqq +0.35$ was found by experiments, where the positive sign is chosen if the aperture plane 4 of the feeding waveguide 2 is outside of the volume between the aperture plane 22 of the horn flange 7 and the bottom surfaces 18, 18' of the horn flange 7 and is chosen as negative, if the aperture plane 4 of the feeding waveguide 2 was inside this volume. Following this rule in FIG.1 the waveguide offset is, therefore, a given a positive sign.

Finally, it can be seen from FIG. 1 that an electrically controlled driving device from the sliding movement of the horn flange 7 on the feeding waveguide 2 is provided. This driving device has for the illustrated embodiment an axially extended rack 23 connected to the sheath 8, said rack 23 engaging with a pinion 24 driven by an electromotor. The electrical motor and the pinion 24 are stationary with respect to a holding part 25, which is again fixed at a radial flange part 26 at the outside of the feeding waveguide 2. By this arrangement the motor can be energized by an electrical signal to a controlled rotation and by this the horn flange 7 can axially be shifted on the feeding waveguide 2. It has been determined by experiments that for the above-mentioned dimensioning of the half opening angle $\theta_o$ of the horn flange 7, the waveguide offset $L/\lambda_o$ can be adjusted in such a position that high aperture efficiency with low sidelobe level and only small spillover is obtained even for the case of deep reflectors, i.e. reflectors, in which the aperture defining ratio of focal length f to the diameter of the reflector is less than 0.35 ($f/D<0.35$). In particular these experiments were performed with the help of different practical models in which the total diameter $d_{ges}$ of the horn flange 7 normalized to the operation wavelength $\lambda_o$ varied in the region $1.86 \leqq d_{ges}/\lambda_o \leqq 3.6$ and the dimensions in FIG. 1 of the other parameters varied in the following regions: $0.59 \leqq d_{TE11}/\lambda_o \leqq 0.82$, $0.25 \leqq s/\lambda_o \leqq 0.35$, $0.07 = b/\lambda_o \leqq 0.12$ and $0.016 \leqq t/\lambda_o \leqq 0.024$.

Such a measured result is represented for the operation frequency of 10.69 GHz, which means an operation frequency in the X band. The half opening angle 8, measured from the central axis of the feeding waveguide to the horn flange was $\theta_o = 73.5°$ and the waveguide offset was $L = 2.0$ mm. On the abscissa is represented the radiating angle, measured from the central axis of the feeding waveguide and on the ordinate the power (one way) measured in the direction of this angle in relative units. Here the curves designated by E and H show the measurement values of the E and the H plane.

Figure 2:
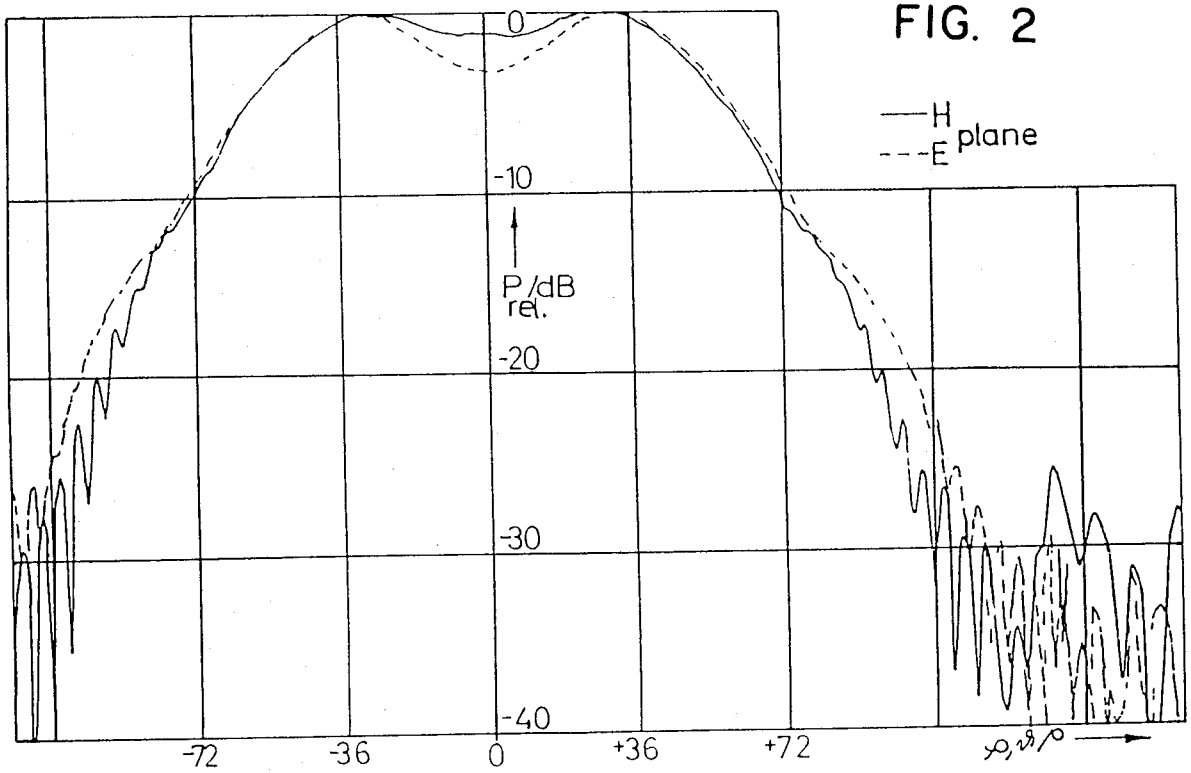
FIG. 2 is an E and H plane pattern of the horn where on the abscissa the radiation angle against the axis of the feeding waveguide and on the ordinate the radiated power (one way) of this angle is shown.

Normally, a rim illumination of the mirror of a reflector antenna of −14 dB compared to the central illumination may be regarded as an acceptable value. Based on this compromise value it follows from FIG. 2 that with a horn feed used there, a reflector of an angular opening of −86° to +86° can satisfactorily be illuminated. Further, following FIG. 2, the common symmetry requirements of a deviation of less than 2 dB between E and H plane inside of this −14 dB rim illumination are satisfactorily fulfilled. As has been shown by experiments, an unacceptable symmetry distortion of the E plane against the H plane will appear if the region of $70° \leqq \theta_o \leqq 80°$ is exceeded. Further a considerable narrowing of the angular region inside the −14 dB rim illumination range occurs.

Finally these experiments have shown that the described horn feed has very good broad band characteristics. For example the measurements have shown that the power measured in the E and H planes shows an essentially flat frequency behaviour over a pattern bandwidth of about 20 °/o of the central frequency. The maximal cross polarization is better than −18 dB compared to the copolarization maximum on the central axis. The relative impedance bandwidth of such feeds can be kept below −20 dB return loss in a region ±5°/o if an iris of narrow width is introduced at about ¼ of the waveguide wavelength inside of the circular waveguide aperture 5.

Figure 3:
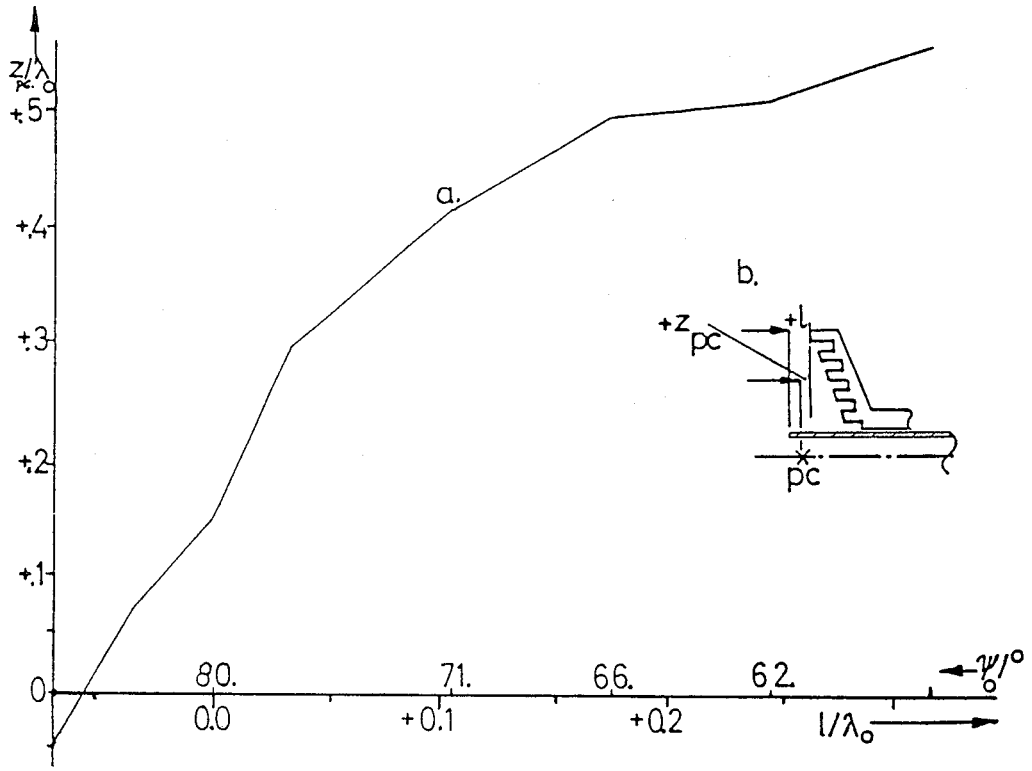
FIG. 3 is a graph of the location of the phase center of the horn, where in FIG. 3(*a*) the location of the phase center of the horn relative to the waveguide aperture and in FIG. 3(*b*) the definition of the abscissa and ordinate parameters are illustrated.

In order to really use the available high aperture efficiency of a reflector antenna with the horn described above it is necessary to put the phase center of the horn 1 in the central convergence zone of the reflector or in its focal zone. But, as can be seen in FIG. 3 the position of this phase center p.c. on the central axis 11 of the feeding waveguide 2 varies simultaneously with the sliding movement of the horn flange 7 on the feeding waveguide 2. In detail, above the abscissa of the curve diagram of FIG. 3, again the offset $L/\lambda_o$ normalized to the wavelength $\lambda_o$ is shown, where in FIG. 3*b* the definition of the parameter L as the distance between the aperture plane 4 of the feeding waveguide 2 and the aperture plane 22 of the horn flange once again is illustrated. The numbers below the abscissa of FIG. 3 represent the half opening angles $\lambda_o$ at which the commonly used rim illumination of the reflector is decreased down to −14 dB. The ordinate of the pattern of FIG. 3*a* gives the phase center position $z_{pc}/\lambda_o$ normalized to the wavelength $\lambda_o$ on the central axis 11 of the feeding waveguide 7 in relation to the aperture plane 22 of the horn flange 7 normalized to the operation wavelength $\lambda_o$ which is also illustrated in FIG. 3*b*.

Figure 4:
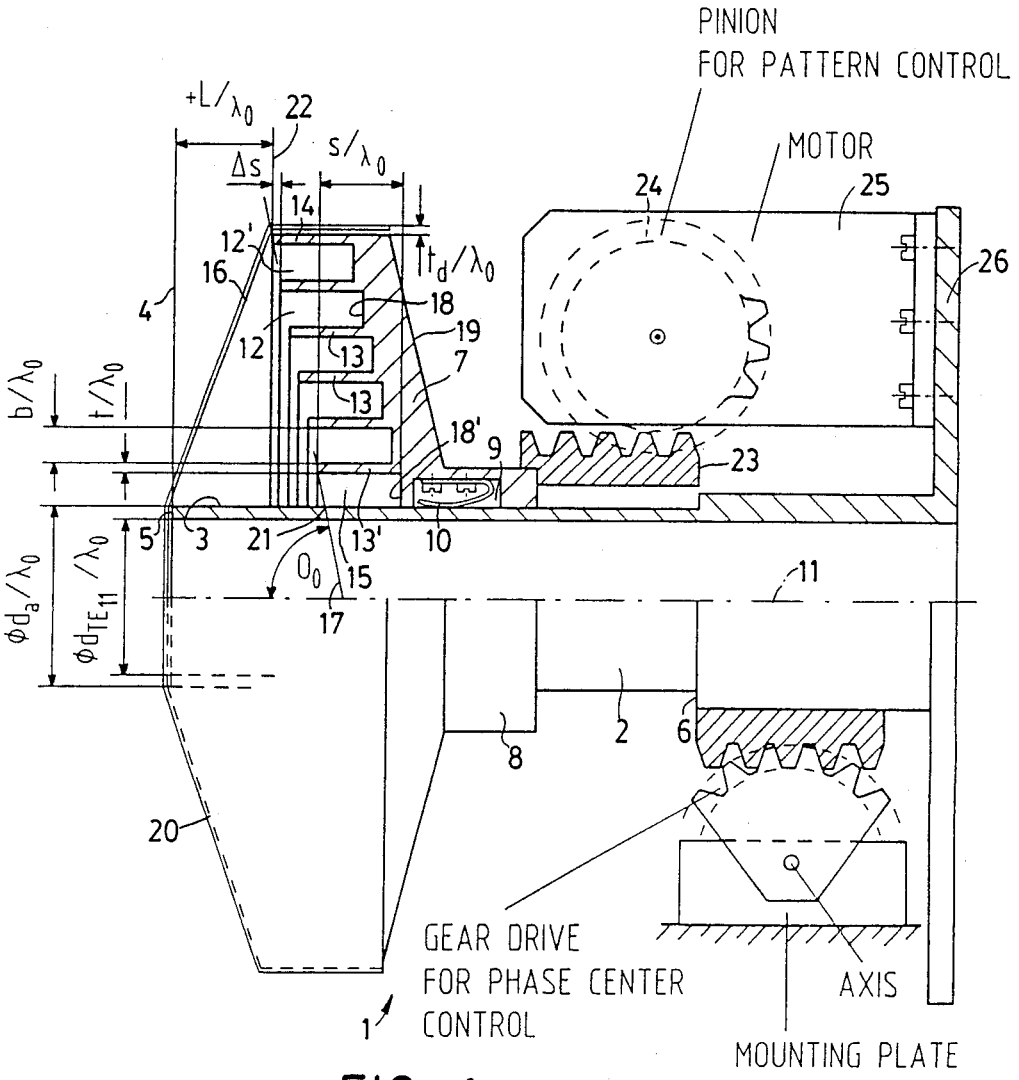
FIG. 4 is a partly cut view of a horn of another embodiment showing an additional drive means for phase center control.

As can be taken from the values of the half opening angle $\Psi_o$ of the reflector corresponding to the −14 dB rim illumination, with increasing misalignment of the phase center, this opening angle decreases considerably, where in this diagram a decrease of 85° to 60° is shown. Therefore, in a further embodiment it is provided that the horn feed 1 is arranged to be shiftable in the reflector, as with a given position of the horn flange 7 on the waveguide 2 the whole horn should be mounted shiftable along the central axis 11 of the feeding waveguide 2 relative to the apex of the reflector in order to put its phase center for any illumination into the central convergence zone or focal sphere of the reflector. For this tracking device another electrical driving unit comparable to this device 23 to 25 at the horn flange 7, and which is shown in FIG. 4 should be provided, which additional driving unit takes hold of the whole horn 1 and shifts the horn flange 7 which is kept fixed in relation to waveguide 2 along the central axis 11.

Instead of looking to a minimum spill-over, as mainly described above, optimization of the adjustment waveguide offset may alternatively consist in adjusting the radiation pattern, e.g. width of main lobe, position of side lobes etc., to a desired optimum while changing the illumination of a given mirror.

We claim:

1. A feed horn for use as a primary focus feed of a reflector antenna, the feed horn having a horn flange located at a free end portion of a tubular $TE_{11}$-mode feeding waveguide, the horn flange widening in a funnel shape radially outwardly from a horn throat fitted on the feeding waveguide and which horn flange has a conical inner surface which is provided with grooves therein of uniform axial depth extending parallel to and coaxially with a central longitudinal axis of the feeding waveguide, the grooves being radially separated by concentric ring-shaped walls therebetween, the walls extending parallel to said central longitudinal axis, characterized in that a half opening angle $\theta°$ of the horn flange (7) defined between the central longitudinal axis (11) of the feeding waveguide (2) and the inner surface of the horn flange lies in the region $70° < \theta° < 80°$ and in that a free end of the feeding waveguide (2) is protrudingly offset axially relative to the intersection between a straight line connecting free axial ends of said walls separating the grooves in the horn flange inner surface and the feeding waveguide, means being provided on the free end portion of the feeding waveguide and on the feed horn for axially shifting the feed horn on the free end portion of the feeding waveguide for adjusting said offset.

2. The feed horn according to claim 1, characterized in that the half opening angle $\theta_o$ lies in the region of $73° \leqq \theta_o \leqq 76°$.

3. The feed horn according to claim 1, characterized in that said offset lies in the region: $-0.25 \leqq L/\lambda_o + 0.35$, where $\lambda_o$ corresponds to a free space operation wavelength and L is the perpendicular distance between an aperture plane (22) of the horn flange (7) defined by a free axial end of a cylindrical outer wall of the horn flange and an aperture plane (4) defined by the free end of the feeding waveguide (2) and where the sign of $L/\lambda_o$ is positive for distances L lying outside an inner horn flange volume enclosed between the funnel-shaped horn flange (7) and the aperture plane (22) of the horn flange and negative for distances L lying inside the inner horn flange volume.

4. The feed horn according to claim 1, characterized by the feeding waveguide (2) being a circular waveguide.

5. The feed horn according to claim 1, characterized in that the horn flange (7) is rotationally symmetrical with respect to the central longitudinal axis (11) of the feeding waveguide (2).

6. The feed horn according to claim 5, characterized in that a surface of the horn flange (7) opposite the inner grooved surface has the form of the surface of a cone of revolution.

7. The feed horn according to claim 1, characterized in that the horn flange (7) is provided at a rear portion thereof with a cylindrical sheath (8) annularly surrounding and fittingly guided on an outer surface (3) of the free end portion of the feeding waveguide (2).

8. The feed horn according to claim 1, characterized in that the horn flange (7) is electrically connected to a contact spring sliding on an outer surface of the feeding waveguide.

9. The feed horn according to claim 1, characterized in that said means for axially shifting the feed horn on the free end portion of the feeding waveguide includes an electrical driving unit mounted between the feeding waveguide and the horn flange.

10. The feed horn according to claim 9, characterized in that the horn flange (7) is provided with a rack (23) extending parallel with respect to the axis (11) of the feeding waveguide (2), and in that the end portion of the feeding waveguide is provided with a pinion driven by an electrical motor which motor is fixedly mounted to the feeding waveguide (2) so as to be stationary with respect thereto, the pinion drivingly engaging the rack of the horn flange.

11. The feed horn according to claim 5, characterized in that an outer diameter of the horn flange $d_{ges}$, an inner diameter of the waveguide $d_{TE11}$, an axial groove depth s, a radial groove distance b, and a radial groove thickness t lie in the ranges $1.86 \leqq d_{ges}/\lambda_o \leqq 3.6$ $0.59 \leqq d_{TE11}/\lambda_o \leqq 0.82$ $0.25 \leqq s/\lambda_o \leqq 0.35$ $0.07 \leqq b/\lambda_o \leqq 0.12$ $0.016 \leqq t/\lambda_o \leqq 0.024$, where $\lambda_o$ is the operation wavelength.

12. The feed horn according to claim 1, characterized in that a phase center (p.c.) of the horn (1) may for any given position of the horn flange (7) on the feeding waveguide (2) be shifted for the whole horn along the central longitudinal axis (11) of the feeding waveguide (2).

13. The feed horn according to claim 12, characterized in that a further electrical driving unit is provided at the horn flange and engages the feed horn while keeping the horn flange in fixed relation to the feeding waveguide, whereby the horn flange and the end portion of the feeding waveguide may be together shifted in fixed relation with one another along the central axis of the feeding waveguide for shifting the phase center (p.c.) of the feed horn.

* * * * *